United States Patent [19]

Chase

[11] Patent Number: 4,526,389

[45] Date of Patent: Jul. 2, 1985

[54] ROLLER SKATE BRAKE

[76] Inventor: J. Burrell Chase, Rte. #1, Box 335, Arcata, Calif. 95521

[21] Appl. No.: 583,843

[22] Filed: Feb. 27, 1984

[51] Int. Cl.[3] ..... A63C 17/14

[52] U.S. Cl. ..... 280/11.21; 188/80; 188/82.84

[58] Field of Search ..... 280/11.19, 11.2, 11.21, 280/11.115; 188/4 B, 29, 80, 82.84

[56] References Cited

U.S. PATENT DOCUMENTS

| | | | |
|---|---|---|---|
| 1,173,343 | 2/1916 | Deacon | 280/11.21 |
| 3,181,635 | 5/1965 | Hale | 188/82.84 X |
| 3,734,244 | 5/1973 | Roddy | 280/11.2 X |
| 4,070,029 | 1/1978 | Panarelli | 280/11.19 |
| 4,181,227 | 1/1980 | Balstad | 280/11.2 |

FOREIGN PATENT DOCUMENTS

| | | | |
|---|---|---|---|
| 746228 | 10/1931 | France | 280/11.21 |
| 2290331 | 6/1976 | France | 188/80 |
| 1584 | of 1893 | United Kingdom | 280/11.21 |

*Primary Examiner*—Joseph F. Peters, Jr.
*Assistant Examiner*—Michael Mar
*Attorney, Agent, or Firm*—Gerald L. Moore

[57] ABSTRACT

A brake for a roller skate that prevents rolling backward comprising a pair of rollers (37) eccentrically mounted on an axle (36) and positioned immediately adjacent the front wheels (17) so as to allow forward rotation but to bind against and brake the wheel when the wheel initiates backward rotation.

2 Claims, 4 Drawing Figures

ROLLER SKATE BRAKE

FIELD OF THE INVENTION

A brake for a roller skate that allows the skate to roll forward but locks the wheel against rolling backward so the skater can walk or skate uphill. The brake can be locked out of engagement when desired.

BACKGROUND OF THE INVENTION

When skating on sidewalks and streets it is frequently necessary to skate or walk uphill and also to walk up stairways. For the average skater it is very difficult and sometimes dangerous to skate uphill because the skates roll backwards as easily as they roll frontward. Additionally in attempting to walk up steps, the skates have a tendency to roll backwards as a forward step is taken to the next level with the result that the skater frequently falls and is injured.

It is the purpose of the present invention to provide a brake which permits even the average skater to skate or walk up hills.

SUMMARY OF THE INVENTION

A roller skate comprising a shoe with at least one wheel rotatably mounted beneath the shoe to allow the wearer to propel forward on the wheel. A braking roller is mounted adjacent the wheel for rotation about an eccentrically positioned shaft with spring means urging the roller into contact with the wheel. Means attached to the roller permit rotation of the roller less than 360 degrees. Forward rolling of the wheel will cause the roller to move away from the wheel and rearward rotation of the wheel will cause the roller to move into tight engagement with the wheel such that with the stopping or rotation of the roller it will brake and hold the wheel from rotating.

DESCRIPTION OF THE INVENTION

Figure 1:
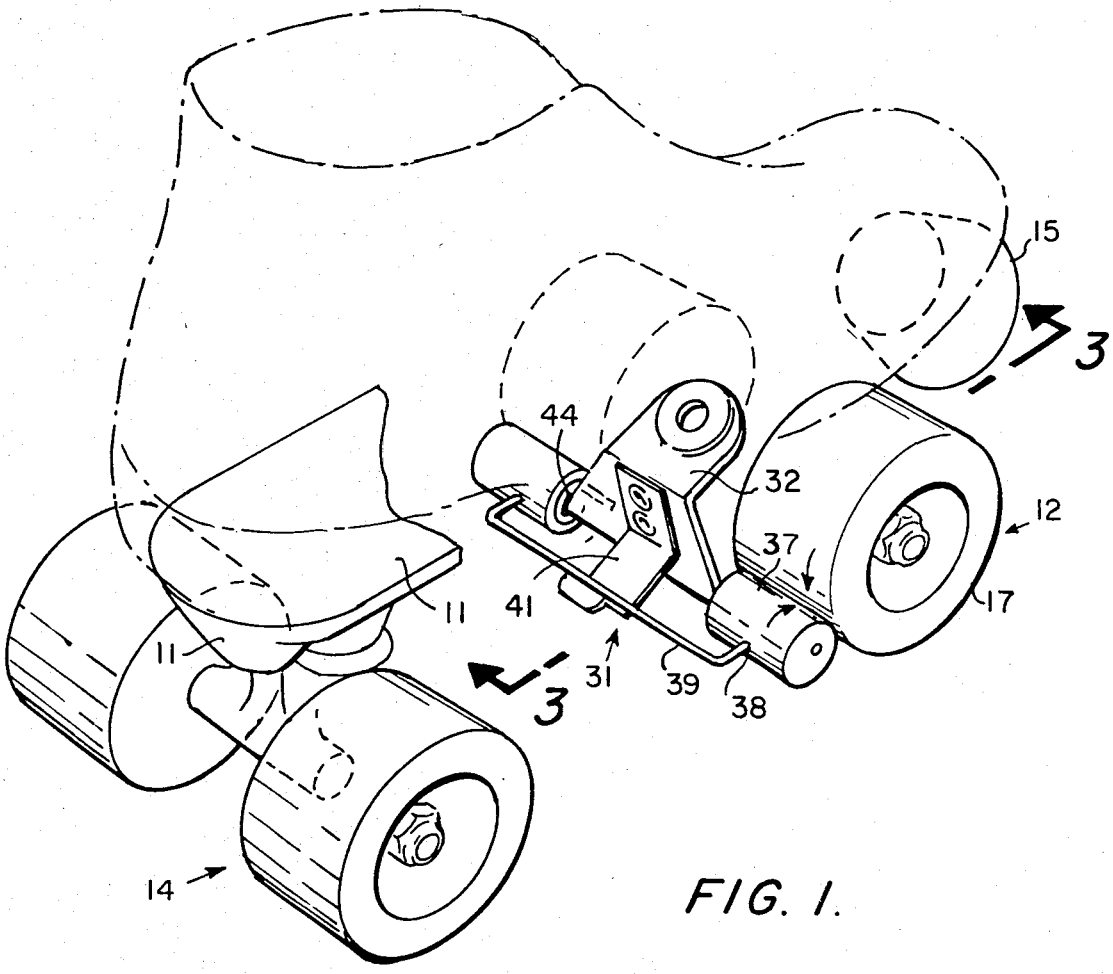
FIG. 1 is a perspective view of a skate showing the brake mechanism.
Figure 2:
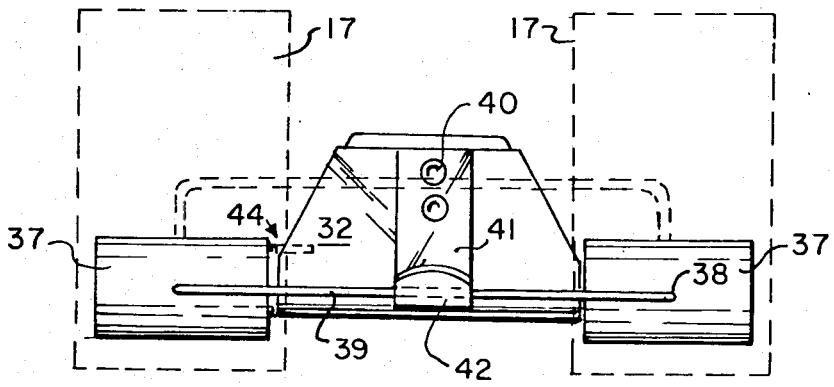
FIG. 2 is a rear view of the brake mechanism showing the skate wheels in dotted outline.

In FIG. 1 is shown a typical roller skate comprising a shoe 10 to which is fixed a bottom plate 11 for attachment of a forward truck assembly 12 and a rear truck assembly 14. A braking pad 15 is also mounted beneath the toe of the shoe. As shown primarily in FIGS. 3 and 4, the forward truck assembly comprises a front axle 16 on which two wheels 17 are rotatably mounted. Between the wheels is a turning bracket 18 having an upper end 19 inserted into a well 20 in the base plate 11 and the other end extending downward to form a shaft opening 21 supporting the wheel axle 16. A rear extension 22 includes an opening 24 through which is passed the bolt 25 which is fixed to the base plate.

Positioned to each side of this bracket on the bolt 25 is a top rubber pad 26 and a bottom rubber pad 27 each fixed to a washer 28 and 29, respectively and held in place by a nut 30 threaded onto the lower extending end of the bolt 25. Thus in the usual manner that such roller skates function, the wheels turn freely but any tilting of the shoe and base plate will pivot the front wheel axle with compression of the rubber pads 26 and 27 and turning of the bracket 18 about the pin 19.

In accordance with the present invention there is provided a brake assembly 31 which is normally mounted on the front truck assembly and which stops rearward rotation of the front wheels. The brake assembly allows a skater to more easily skate up hills by allowing forward thrusting since the skater can push off with the locked front wheels on the rear foot without the need to sidestep. The brake does not interfere with the forward roll of the wheels.

The brake assembly 31 comprises a bracket 32 having an opening 34 to receive the bolt 25. The bracket preferably is mounted between the bottom pad 27 and the bracket rear extension 22. The bracket extends rearward and bends downward to form the segment 32A ending at a point beneath the axle 16 where it is curled back on itself to form a center opening 35 for receiving an axle 36. Mounted on the axle 36 is a pair of rollers 37, one adjacent the periphery of each of the forward skate wheels 17. The roller is perferably made of a hard rubber and is eccentrically mounted on the shaft and each roller has a radially extending opening 38 therein with a rod 39 extending axially along the outer periphery of the rollers and having ends bent normal to extend into each of the roller radial openings. This rod prevents free rotation of the rollers. Fixed by rivets 40 is a spring member 41 extending downward alongside the downward extending segment 32A of the bracket. The lower end is bent horizontal to form a lip 42. Fixed around the axle 36 adjacent each roller is a coil spring 44 having one end 45 fixed to the roller and a second end 46 adjacent the bracket portion 32A.

Figure 3:
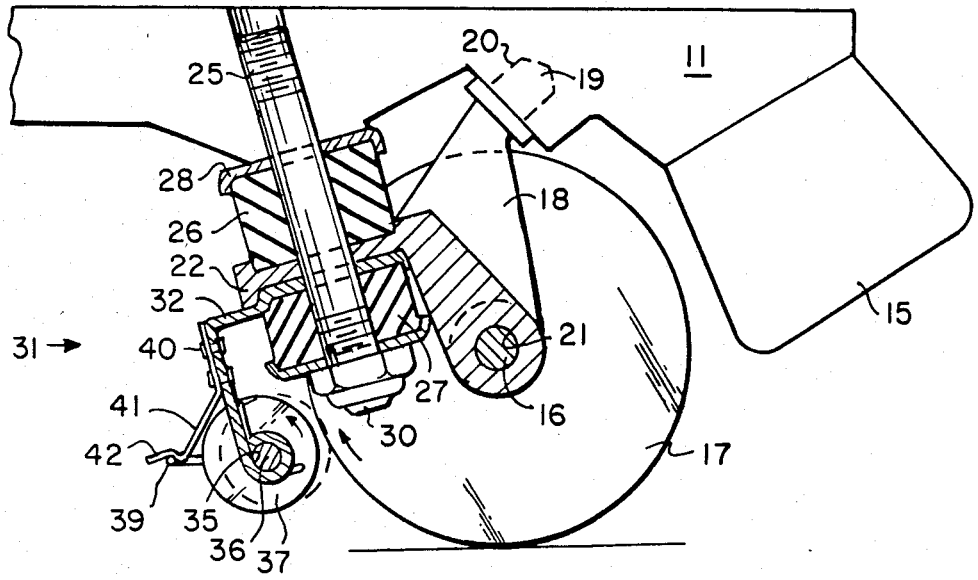
FIG. 3 is a cross-sectional view along the line 3—3 of FIG. 1 showing the brake disengaged.

In operation the skate functions in the normal manner when the rod 39 is positioned beneath the lip 42 in the manner shown in FIG. 3. When in this position the small radius of the roller is positioned towards the skate wheel 17 such that the skate wheel is out of contact with the roller.

Figure 4:
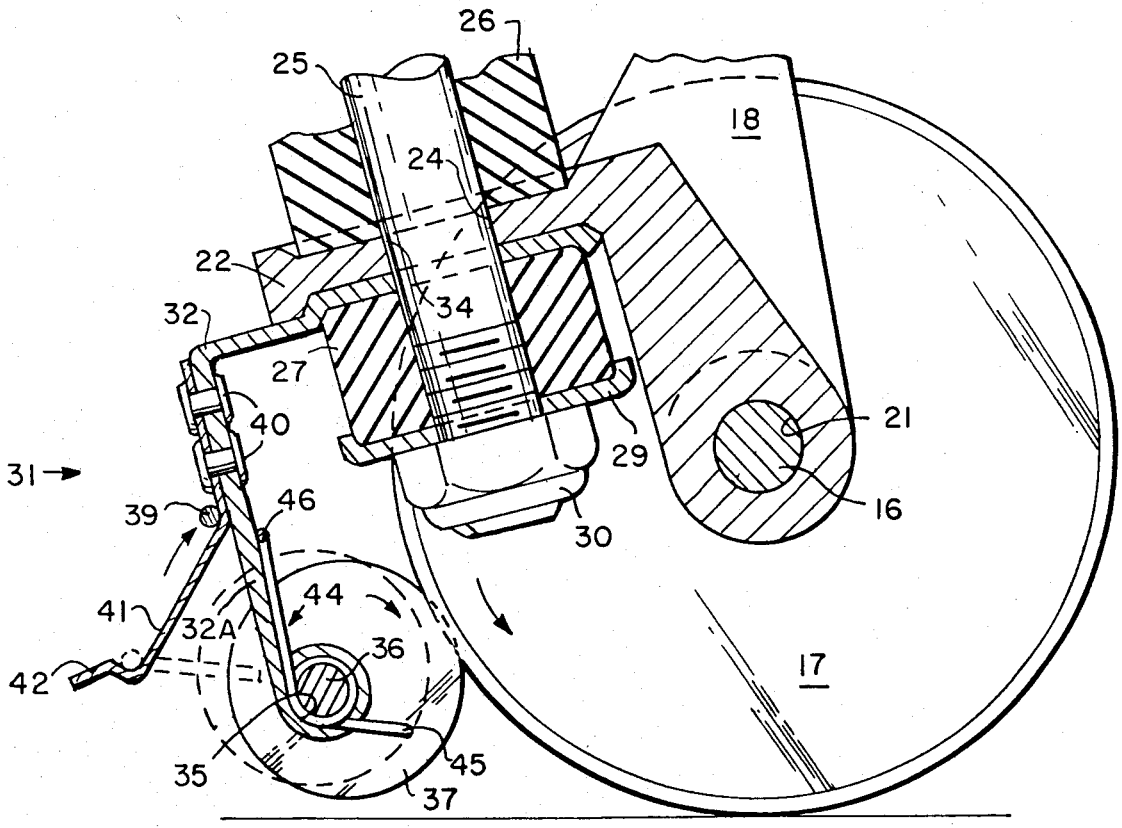
FIG. 4 is an enlarged cross-sectional view similar to that of FIG. 3 and showing the brake engaged.

To set the brake for engagement, the spring 41 is pushed toward the bracket portion 32A and the rod 39 pivoted above the lip 42 to the position shown in FIG. 4. When in this position the wheel 17 can roll in the forward or clockwise direction with little or no hindrance from the roller 37 other than slight contact. However any counterclockwise or rearward rotation of the wheel 17 will result in a clockwise rotation of the roller 37 tending to move the larger diameter portion towards the wheel. Such movement binds the roller and wheel together causing the rod 39 to pivot into engagement with the spring 41 to cease rotation of the roller at or near its maximum radius. When the roller ceases rotation it immediately imparts a braking action on the wheel 17 causing the wheel to cease rotation and lock in place.

Thus there is provided a brake for a roller skate which can be mounted on the standard truck assembly. The brake always remains in a position with the rollers adjacent the wheels since the brake assembly will pivot with the truck assembly because of the juxtapositioned bracket segment 32 and the bracket 22. In addition the brake can always be disengaged so that the skate will roll rearward in the normal manner. Such disengagement is easily effected by merely moving the rod 39 around the lip 42 of the spring member 41.

While the subject invention has been described for use in roller skates, other uses are also contemplated. For instance such a brake mechanism could be used on a wheelbarrow to prevent backward rotation of the wheel. This would prevent rolling backward when pushing the wheelbarrow up inclines.

The invention claimed:

1. A brake for a roller skate with a shoe having fixed thereto a truck assembly supporting an axle on which is mounted two parallel positioned wheels capable of rotating in the forward and reverse directions and the axle is supported to turn when the shoe is tilted relative to the truck assembly wheels, said brake comprising:

a shaft;

a roller eccentrically mounted on each end of said shaft to include radial sections having large and small radii;.

means mounting said shaft on said skate with each of said rollers having a small radius section abutting one of said wheels peripheries and positioned to be rotated to bring a large radius section into contact with its respective wheel when the wheels are rotated in the reverse direction to thereby increase the contact pressure between each wheel and its respective roller;

said means mounting said shaft including a bracket fixed to tilt and turn the roller with the axle so as to maintain equal roller pressure on the wheels of the truck assembly; and means stopping rotation of said roller so the roller will brake rotation of the wheel when the wheel is rotated in the reverse direction.

2. A brake as defined in claim 1 including means to releasably hold said roller out of contact with said wheel when deactivated.

* * * * *